US007673460B2

(12) United States Patent
Hernandez et al.

(10) Patent No.: US 7,673,460 B2
(45) Date of Patent: Mar. 9, 2010

(54) SYSTEM OF ATTACHING AN INJECTION SYSTEM TO A TURBOJET COMBUSTION CHAMBER BASE

(75) Inventors: Didier Hippolyte Hernandez, Quiers (FR); Romain Nicolas Lunel, Brie Comte Robert (FR); Christophe Pieussergues, Nangis (FR); David Pinchon, Milly la Foret (FR); Guillaume Sevi, Ivry sur Seine (FR)

(73) Assignee: SNECMA, Paris (FR)

( * ) Notice: Subject to any disclaimer, the term of this patent is extended or adjusted under 35 U.S.C. 154(b) by 887 days.

(21) Appl. No.: 11/422,177

(22) Filed: Jun. 5, 2006

(65) Prior Publication Data

US 2007/0084215 A1 Apr. 19, 2007

(30) Foreign Application Priority Data

Jun. 7, 2005 (FR) ..... 05 51518
Sep. 28, 2005 (FR) ..... 05 52929

(51) Int. Cl.
*F23R 3/60* (2006.01)

(52) U.S. Cl. ..... 60/796; 60/752

(58) Field of Classification Search ..... 60/748, 60/752, 796, 800, 756
See application file for complete search history.

(56) References Cited

U.S. PATENT DOCUMENTS

| | | | | |
|---|---|---|---|---|
| 4,216,652 | A | 8/1980 | Herman et al. | |
| 6,212,870 | B1 | 4/2001 | Thompson et al. | |
| 6,442,940 | B1 * | 9/2002 | Young et al. | 60/748 |
| 6,502,400 | B1 | 1/2003 | Freidauer et al. | |
| 6,782,620 | B2 * | 8/2004 | Caldwell et al. | 29/890.01 |

* cited by examiner

*Primary Examiner*—Louis J Casaregola
(74) *Attorney, Agent, or Firm*—Oblon, Spivak, McClelland, Maier & Neustadt, L.L.P.

(57) ABSTRACT

A system of attaching an injection system to a turbojet combustion chamber base. It comprises a deflector welded onto the chamber base. The deflector comprises an annular portion having an edge forming a retaining shoulder directed toward the front of the turbojet and the injection system comprises a collar on which is formed a retaining shoulder directed toward the rear of the turbojet and pressing against the retaining shoulder of the deflector.

13 Claims, 5 Drawing Sheets

SYSTEM OF ATTACHING AN INJECTION SYSTEM TO A TURBOJET COMBUSTION CHAMBER BASE

BACKGROUND OF THE INVENTION

1. Technical Field

The invention relates to a system of attaching an injection system to a turbojet combustion chamber base.

The combustion chambers of turbojets comprise an inner wall and an outer wall connected at their upstream end via an annular base to define a combustion chamber base. Injection systems evenly distributed over the periphery of the combustion chamber base deliver a mixture of air and fuel that is burned to provide combustion gases.

Each injection system comprises a venturi in which the air and the fuel mix. A bowl, situated downstream of the venturi, has the function of breaking up the jet of air/fuel mixture coming out of the venturi. In addition, a deflector protects the chamber base from the flames of the combustion chamber.

2. Description of the Prior Art

In a known embodiment (U.S. Pat. No. 4,584,834), the injection system is mounted from downstream, that is to say via the rear of the turbojet. In a system of this type, the injection system is welded onto the chamber base directly or via an intermediate part; the deflector and the bowl are welded onto the injection system. If the weld situated between the injection system and the bowl fails, the latter impacts the combustion chamber and the downstream portion of the engine, particularly the HP turbine, which may lead to the engine exploding. In the same manner, if the weld situated between the injection system and the deflector fails, the latter will, in a first time, be held by the bowl but the additional forces exerted on the bowl will ultimately cause the weld situated between the injection system and the bowl to fail also so that the two parts will be thrown simultaneously into the combustion chamber and into the downstream portion of the engine with the same consequences as hereinabove.

In addition, beside the risk of a weld rupturing, it is not easy to dismantle an injection system in order to carry out its maintenance or replacement. Specifically, this operation requires removing three welds at the same time, which is awkward and most frequently requires the sacrifice of a part, usually the injection system itself. The object of the present invention is an injection system and an attachment method that remedy these disadvantages.

SUMMARY OF THE INVENTION

These objectives are achieved by the fact that the deflector comprises an annular portion having an edge forming a retaining shoulder directed toward the front of the turbojet and by the fact that the injection system comprises a collar on which is formed a retaining shoulder directed toward the rear of the turbojet and pressing against the retaining shoulder of the chamber base.

In one embodiment, the deflector comprises a retaining groove and a retaining ring comprises a rim inserted into the retaining groove.

With these features, the deflector is still mounted via the downstream portion of the chamber base but it is held mechanically by the rim of the retaining ring inserted into its retaining groove. Thus, even if the weld between the chamber base and the deflector ruptures, the latter cannot be sucked into the combustion chamber.

Furthermore, the bowl of the injection system is mounted via the front portion of the turbojet. Its retaining shoulder provides a mechanical attachment such that it also cannot be sucked into the turbojet combustion chamber.

Advantageously, the deflector and the retaining ring are welded in one and the same welding operation.

The injection system is attached to the retaining ring by seam welds.

These seam welds do not provide mechanical strength because the forces are sustained by the retaining shoulder of the injection system. They are therefore less likely to rupture and, even if that did happen, the injection system would all the same be held in front of the chamber base.

In a particular embodiment, the retaining ring is a split ring.

In another embodiment, the collar of the injection system also comprises a shoulder directed toward the front of the turbojet and the retaining ring comprises a second rim that comes to immobilize the second rim of the injection system.

In a particular embodiment, the retaining ring consists of an inner ring that is split or formed of two half-rings and a fastening ring which encircles the inner ring.

Advantageously, the split ring has a conical bearing surface to eliminate the axial clearances.

The inner ring is attached to the fastening ring by spot welds.

Again advantageously, the first shoulder directed toward the front of the turbojet and the second shoulder directed toward the rear of the turbojet are formed on a collar of a bowl forming part of the injection system.

According to the method of attaching an injection system to a turbojet combustion chamber base:

- a deflector comprising an annular portion having an edge forming a retaining shoulder directed toward the front of the turbojet is inserted into a hole of the chamber base;
- a retaining ring is mounted onto the deflector via the front of the turbojet;
- the deflector is welded onto the chamber base and simultaneously the retaining ring is welded onto the deflector;
- via the front of the turbojet, an injection system is inserted into the deflector, the injection system comprising a shoulder directed toward the rear of the turbojet that comes to press on the retaining shoulder of the deflector;
- the injection system is welded onto the retaining ring by seam welds.

According to a variant of the method:

- a deflector comprising an annular portion having an edge forming a retaining shoulder directed toward the front of the turbojet is inserted into a hole of the chamber base, the deflector comprising a retaining groove;
- the deflector is welded onto the chamber base;
- via the front of the turbojet, an injection system is inserted into the deflector, the injection system comprising a first shoulder directed toward the rear of the turbojet that comes to press on the retaining shoulder of the deflector and a second shoulder directed toward the front of the turbojet;
- a retaining ring comprising a first rim that comes to lodge itself in the retaining groove of the deflector and a second rim that comes to immobilize the second shoulder of the injection system are mounted;
- the injection system is attached to the deflector by producing seam welds between the retaining ring and the fastening ring.

Other features and advantages of the invention will appear on reading the following description of exemplary embodiments given as illustrations with reference to the appended figures.

DESCRIPTION OF THE PREFERRED EMBODIMENTS

Figure 1:
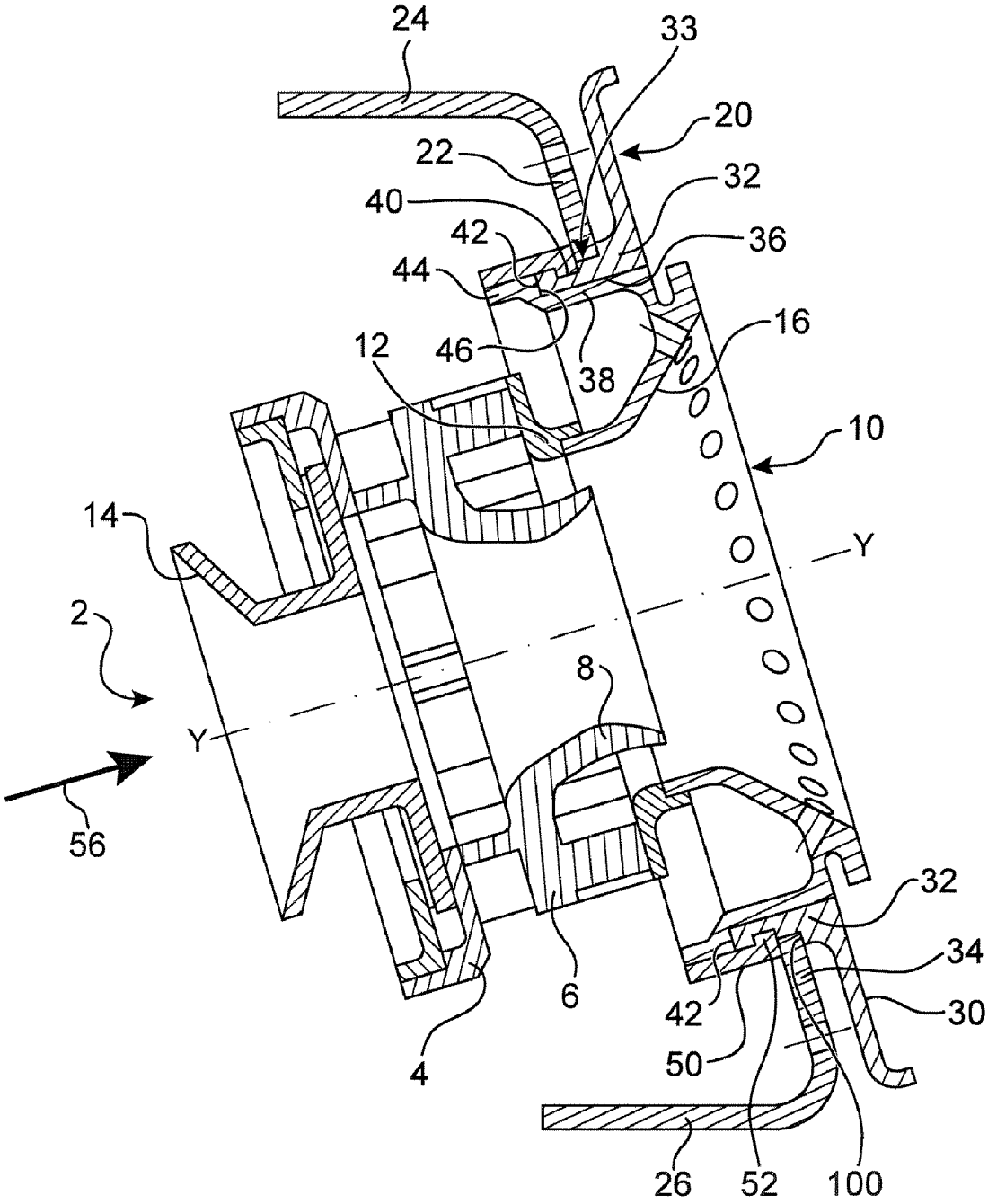
FIG. 1 is a view in section of a first embodiment of an injection system according to the present invention.

In FIG. 1, the injection system, indicated in its entirety by the general reference number 2, consists of a fixed portion consisting of a ring 4, a swirler element 6, a venturi 8 and a bowl 10. The swirler element 6 and the bowl 10 are connected to one another via an intermediate ring 12. A sliding crossmember 14 is mounted so as to slide on the ring 4. The swirler element comprises two blade stages whose function is to rotate the air about the longitudinal axis YY of the injection system. The bowl 10 comprises a flared shape 16 whose function is to cause the jet of air and fuel mixture coming out of the venturi 8 to break up.

A deflector 20 is mounted on the chamber base 22. The chamber base itself comprises two clamping zones 24 and 26. The clamping zone 24 is connected to an outer chamber wall (not shown) and the inner clamping zone 26 is connected to an inner chamber wall, also not shown. A plurality of injection systems, typically from 13 to 32, evenly spaced angularly, are mounted on the chamber base 22 (only one injection system has been shown in FIG. 1).

The deflector 20 comprises a plate 30 and an annular portion 32 welded onto the chamber base. The function of the plate 30 is to protect the portion of the chamber base situated around the injection system 2 from the flames from the combustion chamber. The annular portion 32 is inserted into a hole 33 formed in the chamber base. It comprises a shoulder 100 that presses against the wall downstream of the chamber base. Internally, the annular portion 32 comprises a bore 36 in which a cylindrical portion 38 of the bowl 10 comes to lodge itself. In addition, the annular portion 32 of the deflector comprises a retaining groove 40. The edge 42 of the annular portion 32 of the deflector forms a retaining shoulder. The cylindrical portion 38 of the bowl 10 is extended by a collar 44 of larger diameter comprising a retaining shoulder 46 directed toward the rear of the turbojet and pressing against the retaining shoulder 42 of the deflector. A split retaining ring 50 comprises a rim 52 inserted into the retaining groove 40 of the deflector 20. Seam welds 54, for example three or four (see FIG. 2), provide a connection between the collar 44 of the bowl 10 and the retaining ring 50.

The injection system is mounted onto the chamber base as follows. First the deflector 20 is inserted into the orifice 33 made in the chamber base and then the split retaining ring 50 is mounted onto the deflector so that the rim 52 comes to lodge itself inside the annular retaining groove 40 of the deflector. These two pieces are then assembled together and to the chamber base 22 via a single welding operation. The injection system is then mounted via the front of the turbojet, as schematized by the arrow 56 (FIG. 1) so that the cylindrical portion 38 of the bowl comes to be mounted inside the bore 36 of the deflector. In this position, the shoulder 46 formed on the portion 44 of the bowl presses against the edge 42 of the annular portion 32 forming a retaining shoulder. Advantageously, the front end of the portion 44 is at the same level as the front end of the split ring 50 so that it is possible to produce seam welds 54 to fixedly attach these two pieces together.

In this embodiment, as can be seen, the deflector 20 is held mechanically by the rim 52 of the split ring 50. In this way, even if the weld connecting the deflector to the chamber base 22 should fail, the latter cannot be sucked into the front portion of the turbojet. Furthermore, the injection system 2 and more particularly the bowl 10 are mounted via the front of the turbojet and they are held mechanically by the shoulder 46 of the collar 44 of the bowl butting against the shoulder of the deflector 42. Thus, the spot welds 54 do not provide mechanical strength but simply have the function of preventing the injection system 2 from rotating relative to the split ring 50.

Furthermore, the operations of dismantling the injection system are made easier, for example when it is desired to replace a faulty injection system.

Specifically, all that is required is to grind off the seam welds 54 thereby releasing the injection system and making it possible to remove it by moving it in a direction opposite to the direction of the arrow 56 (FIG. 1). The welds of the deflector on the chamber base and of the split ring on the deflector are not touched. In the same manner, the new injection system is installed very simply since all that is required is to insert it into the bore 36 and to produce new seam welds 54. Thus, this device provides many advantages, on the one hand because it eliminates the risk that the pieces are drawn into the combustion chamber and into the downstream portion of the engine, particularly the high pressure turbine and, on the other hand because it makes the maintenance and repair operations easier by making it possible to replace a faulty injection system much more easily.

Figure 2:
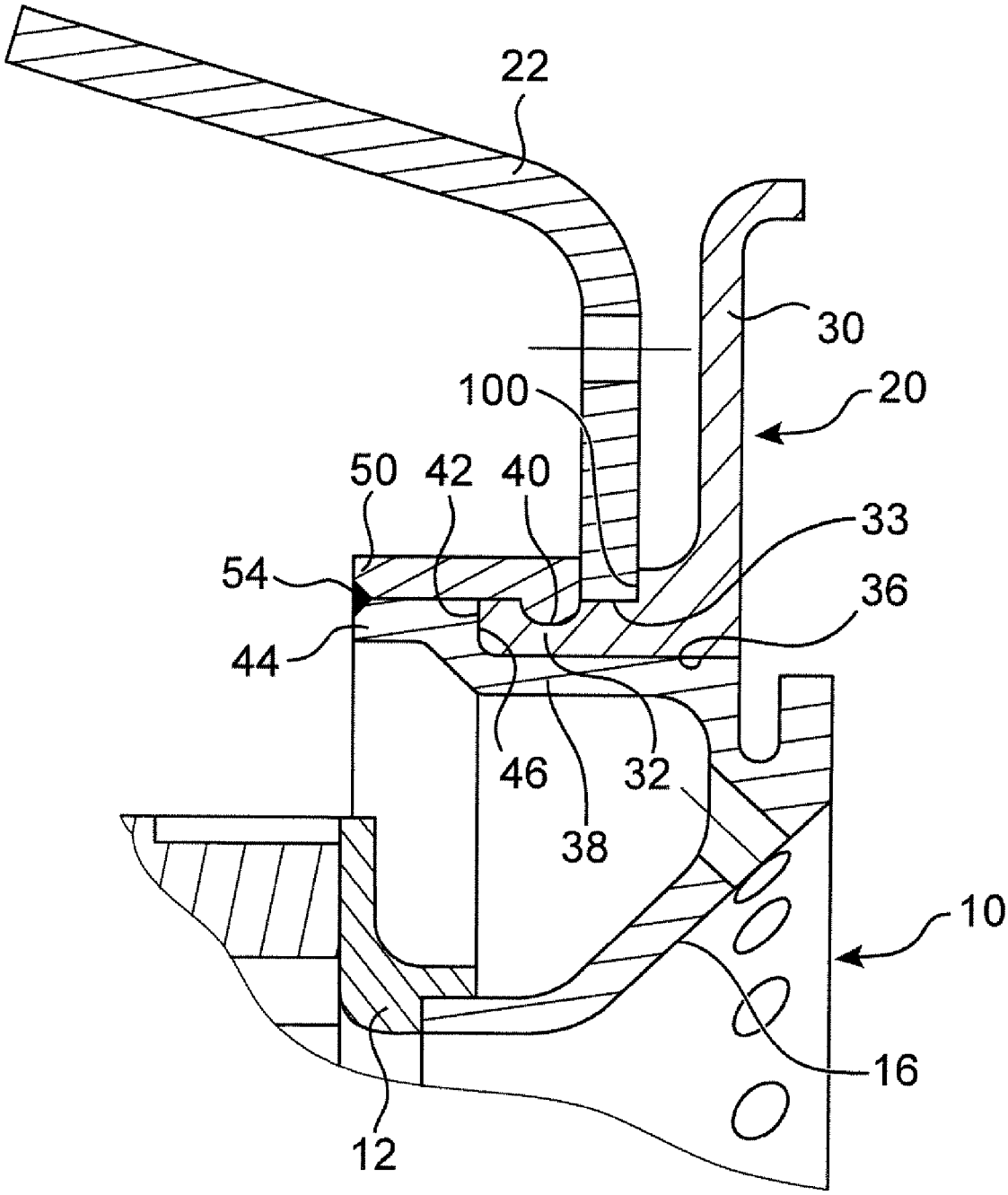
FIG. 2 is an enlarged detail view of FIG. 1.
Figure 3:
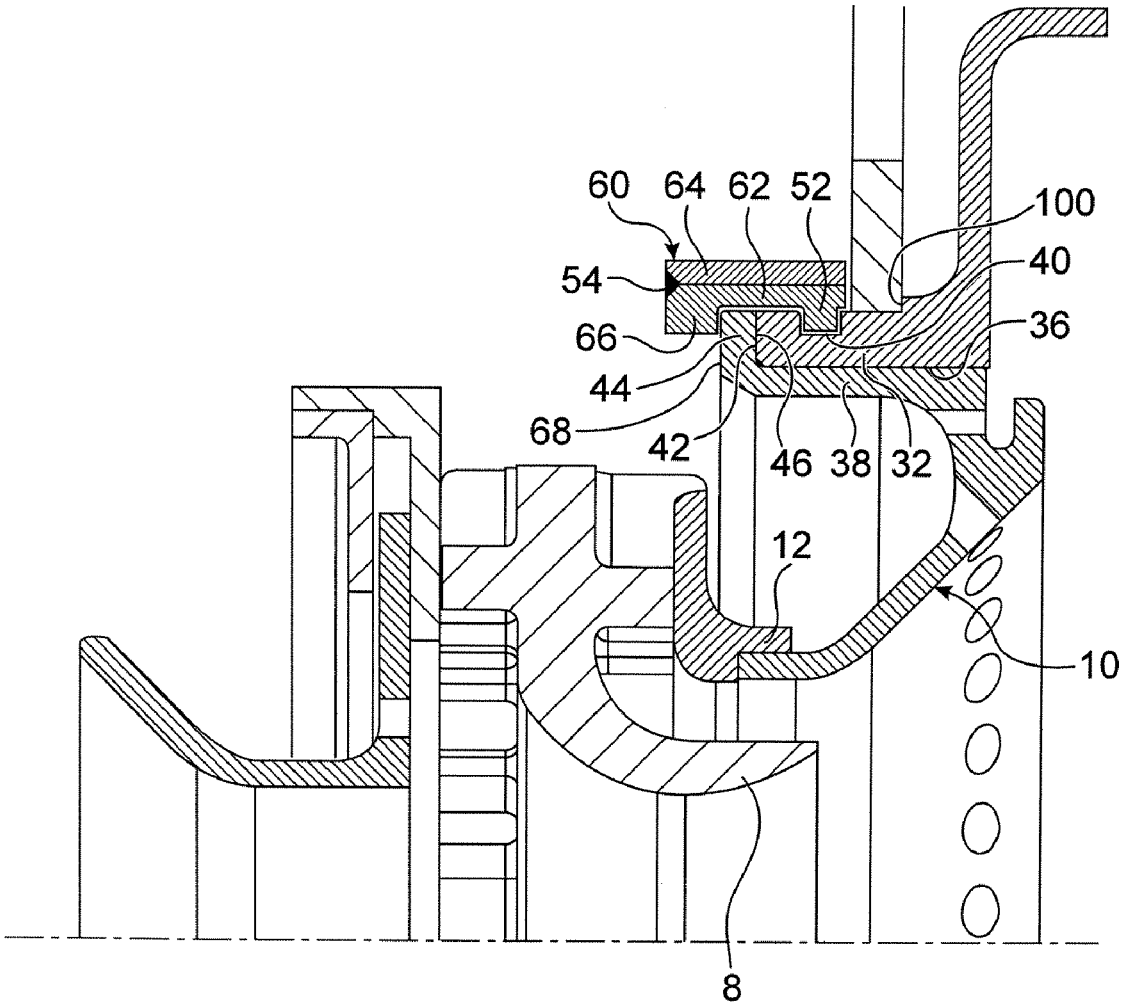
FIG. 3 is a half-view in section of a second embodiment of the attachment system of the invention.

FIG. 3 shows a variant embodiment of the attachment system of FIGS. 1 and 2.

In the embodiment of FIGS. 1 and 2, as has been explained, neither the deflector, nor the bowl of the injection system can be drawn toward the rear of the turbojet in the event of rupture of the welds because they are held mechanically. However, if a force is exerted on the injection system in the reverse direction, that is to say in the direction opposite to that of the arrow 56 of FIG. 1, the force will be sustained by the seam welds which may then fail. A force of this type may occur when the injectors are placed on the sliding crossmember because there may be a bracing of the injectors. The forces sustained by the spot welds in such a situation could, in some circumstances, cause them to break. In this case, the bowl would become detached from the chamber base 22. This situation would cause fewer problems than the reverse situation in which the bowl could be drawn toward the rear of the turbojet because the injection system would be held by the injectors and the pressure. However, in order to prevent this disadvantage, an embodiment of the invention represented in FIGS. 3 and 4 has been provided in which the injection system, and particularly the bowl forming part of the injection system, is held mechanically in both directions without any force being exerted on the seam welds.

Figure 4:
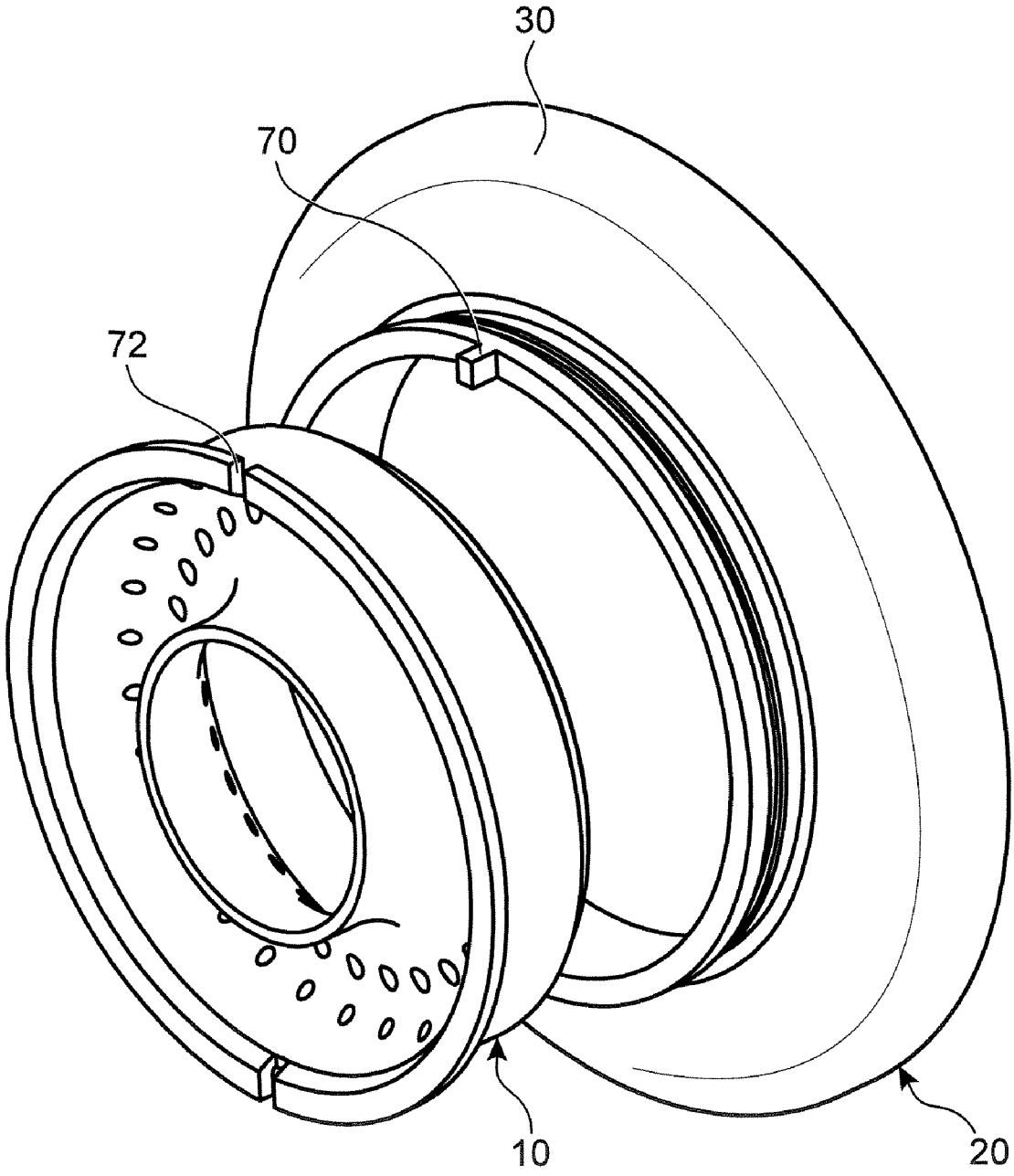
FIG. 4 is a view in perspective of the bowl mounted on the deflector of the injection system of FIG. 3.

In this embodiment, the shape of the deflector 20 is identical. On the other hand, the constitution of the retaining ring differs. The retaining ring 60 consists of an inner ring 62 and a fastening ring 64. The inner ring may be split as in the preceding embodiment or else it may consist of two half-rings. As previously, it comprises a rim 52 that comes to lodge itself in the groove 40 of the deflector and, in addition, a second rim 66 which comes to immobilize a collar 44 situated at the end of the cylindrical portion 38 of the bowl. The collar 44 is thus immobilized in both directions. Toward the rear of the turbojet, it is immobilized as previously by the edge 42 of the annular portion of the deflector 20. In the other direction, that is to say toward the front of the turbojet, it is immobilized by the second rim 66 of the inner ring 62. The fastening ring 64 encircles the inner ring 62 so as to prevent the split ring or the two half-rings from spreading. Seam welds 54 fixedly attach the fastening ring 64 and the inner ring 62. However, in this embodiment, unlike the previous embodiment, the seam welds 54 do not support any mechanical load. The injection system is prevented from moving, in both directions, exclusively by the rims 52 and 66. However, as can be seen in FIG. 4, it is necessary to provide anti-rotation means. Specifically, in the embodiment of FIGS. 1 and 2, the anti-rotation function is provided by the spot welds 54 themselves, which is no longer the case in the present embodiment. This is why (FIG. 4) the deflector comprises a lug 70, of substantially rectangular section for example, which comes to lodge itself in a corresponding notch 72 of the same shape and the same cross section formed in the collar 44 of the bowl 10. This prevents the bowl from rotating relative to the deflector which is itself welded to the base wall as has been explained hereinabove.

Figure 5:
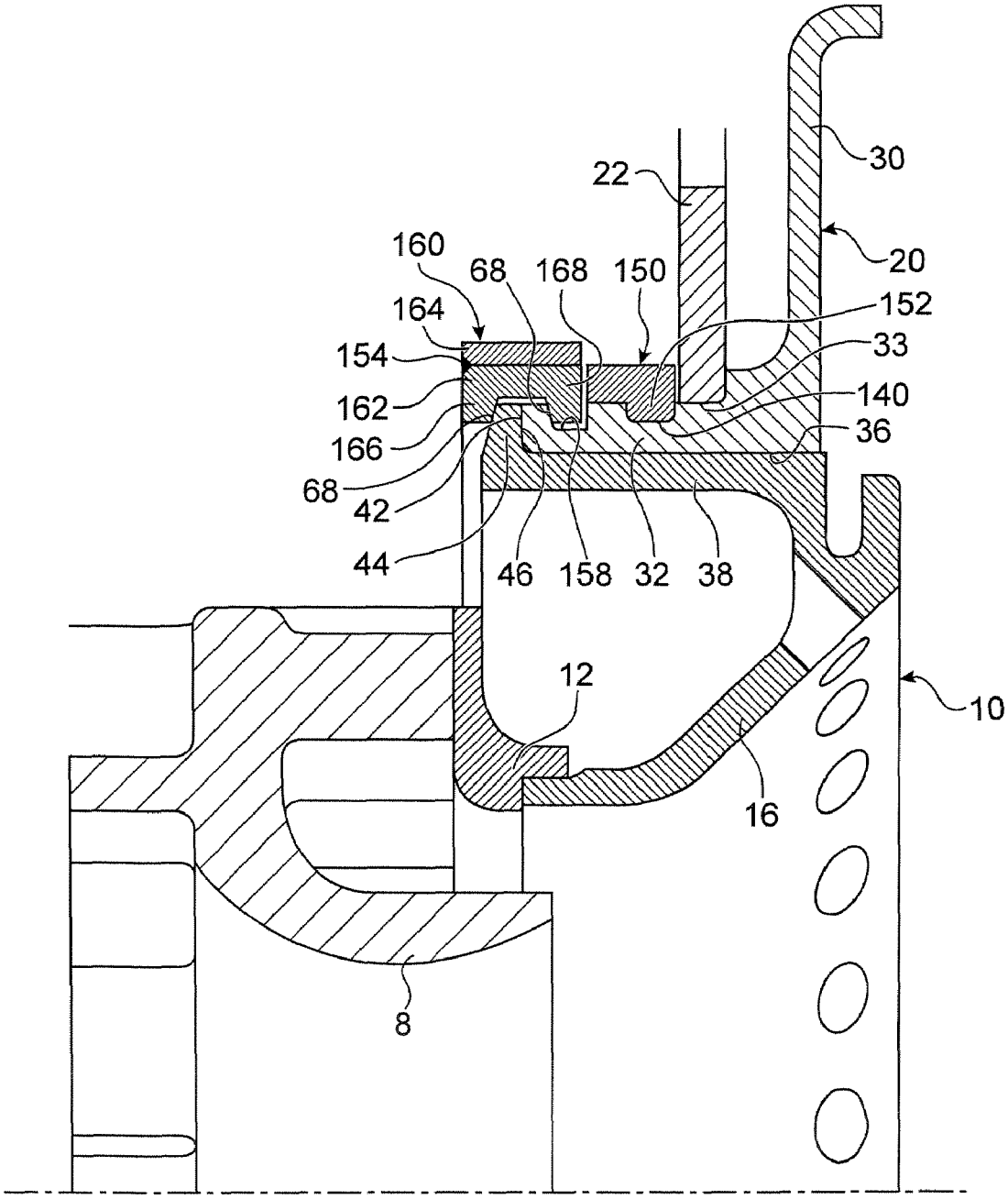
FIG. 5 is a view in section of a third embodiment of the attachment system of the invention.

FIG. 5 represents a third embodiment of the invention which combines the features of the first embodiment and the second embodiment of FIGS. 1 and 2 on the one hand, and FIGS. 3 and 4 on the other hand. In this embodiment, the deflector 20 is attached to the chamber base 22 both by welding and mechanically by means of a welded split ring 150 comprising a rim 152 which enters a circular groove 140 formed in the annular portion 32 of the deflector 20. This embodiment is similar to the embodiment of FIGS. 1 and 2. Furthermore, the annular portion of the deflector comprises a second circular groove 158 designed to receive one of the rims of a retaining ring 160. As has been described hereinabove with reference to FIGS. 3 and 4, the retaining ring consists of an inner ring 162 and a fastening ring 164 which encircles the inner ring 162.

As above, the inner ring 162 may consist of a split ring or of two half-rings. The inner ring comprises a first rim 166 and a second rim 168. The inner ring has conical bearing surfaces allowing the axial clearances to be eliminated. The axial forces which tend to open the split ring or the two half-rings are sustained by the fastening ring 164. Seam welds 154 provide a connection between the inner ring 162 and the fastening ring 164. These seam welds are not acted upon mechanically.

This embodiment operates also if the bearing surfaces are not conical. There then remains a slight axial clearance due to the manufacturing tolerances.

The invention claimed is:

1. A system of attaching an injection system to a turbojet combustion chamber base, the system comprising:

a deflector welded onto the chamber base, the deflector comprising an annular portion with an edge that provides a retaining shoulder directed toward the front of the turbojet, and a retaining groove; and a retaining ring that includes a rim configured to cooperate with the retaining groove so as to restrain the deflector in an axial direction, wherein the injection system comprises a collar on which is provided a retaining shoulder directed toward the rear of the turbojet and configured to press against the retaining shoulder of the deflector.

2. The attachment system as claimed in claim 1, wherein the retaining ring and the deflector are welded in one and the same welding operation.

3. The attachment system as claimed in claim 2, wherein the injection system is attached to the retaining ring by seam welds.

4. The attachment system as claimed in claim 2, wherein the retaining ring is a split ring.

5. The attachment system as claimed in claim 1, wherein the collar of the injection system further comprises a second shoulder directed toward the front of the turbojet and wherein the retaining ring comprises a second rim configured to immobilize the second shoulder of the injection system.

6. The attachment system as claimed in claim 5, wherein the retaining comprises an inner ring that is split or formed of two half-rings, and a fastening ring configured to encircle the inner ring.

7. The attachment system as claimed in claim 6, wherein the inner ring includes conical bearing surfaces.

8. The attachment system as claimed in claim 5, wherein the first shoulder of the injection system directed toward the rear of the turbojet, and wherein the second shoulder of the injection system directed toward the front of the turbojet are formed on a collar of a bowl forming part of an injection system.

9. A combustion chamber fitted with an attachment system as claimed in claim 1.

10. A turbomachine comprising a combustion chamber as claimed in claim 9.

11. The attachment system as claimed in claim 1, wherein the rim protrudes in a radially inward direction and the retaining groove is disposed on an outer circumference of the annular portion of the deflector.

12. The attachment system as claimed in claim 1, wherein the retaining ring directly contacts a first face of the chamber base in the axial direction, the deflector axially contacts a second face of the chamber base in the axial direction, and the first face of the chamber base is disposed closer to the front of the turbojet than the second face of the chamber base.

13. The attachment system as claimed in claim 1, wherein an inner circumference of the retaining ring directly contacts an outer circumference of the collar of the injection system and an outer circumference of the annular portion of the deflector.

* * * * *